US011312142B2

(12) United States Patent
Arnold et al.

(10) Patent No.: US 11,312,142 B2
(45) Date of Patent: Apr. 26, 2022

(54) PRINTING DEVICES WITH REMOVEABLE EXTRACTION RESERVOIRS

(71) Applicant: HEWLETT-PACKARD DEVELOPMENT COMPANY, L.P., Spring, TX (US)

(72) Inventors: Christopher John Arnold, Vancouver, WA (US); Jefferson P. Ward, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/499,301

(22) PCT Filed: Jul. 13, 2018

(86) PCT No.: PCT/US2018/041966
§ 371 (c)(1),
(2) Date: Sep. 29, 2019

(87) PCT Pub. No.: WO2020/013842
PCT Pub. Date: Jan. 16, 2020

(65) Prior Publication Data

US 2021/0362505 A1 Nov. 25, 2021

(51) Int. Cl.
*B41J 2/175* (2006.01)

(52) U.S. Cl.
CPC ..... *B41J 2/17509* (2013.01); *B41J 2/17546* (2013.01); *B41J 2/17596* (2013.01)

(58) Field of Classification Search
CPC .... B41J 2/175; B41J 2/17509; B41J 2/17513; B41J 2/17523; B41J 2/17546; B41J 2/1755; B41J 2/17566; B41J 2/17596; B41J 2/18; B41J 29/02
See application file for complete search history.

(56) References Cited

U.S. PATENT DOCUMENTS

| | | | | |
|---|---|---|---|---|
| 4,999,652 | A * | 3/1991 | Chan | B41J 2/17513 347/86 |
| 5,126,767 | A * | 6/1992 | Asai | B41J 2/17523 347/86 |
| 5,691,753 | A | 11/1997 | Hilton | |
| 5,748,216 | A | 5/1998 | Scheffelin et al. | |
| 5,793,389 | A | 8/1998 | Mitchell | |
| 6,398,351 | B1 | 6/2002 | Blum et al. | |
| 6,572,215 | B2 | 6/2003 | Sharma | |
| 7,048,348 | B2 | 5/2006 | Mochizuki et al. | |
| 7,261,400 | B2 | 8/2007 | Silverbrook | |

(Continued)

FOREIGN PATENT DOCUMENTS

| | | |
|---|---|---|
| EP | 1382450 A1 | 1/2004 |
| GB | 2316657 A | 3/1998 |

(Continued)

*Primary Examiner* — Anh T Vo
(74) *Attorney, Agent, or Firm* — Brooks Cameron & Huebsch PLLC

(57) ABSTRACT

A printing device may include an input port to interface with a supply simulator; and a drain fluidic interface to interface with a removable extraction reservoir simultaneously with the coupling of the supply simulator with the input port; the supply simulator comprising a memory device to transfer data related to an amount of fluid transferred between the printing device and the removable extraction reservoir.

16 Claims, 8 Drawing Sheets

(56) References Cited

U.S. PATENT DOCUMENTS

| | | | |
|---|---|---|---|
| 7,934,816 | B2 | 5/2011 | Tsukahara et al. |
| 2004/0212651 | A1 | 10/2004 | Johnson et al. |
| 2010/0091077 | A1 | 4/2010 | Silverbrook |
| 2016/0305246 | A1 | 10/2016 | Welch et al. |

FOREIGN PATENT DOCUMENTS

| | | |
|---|---|---|
| JP | 2004050839 | 2/2004 |
| JP | 2005238832 | 9/2005 |
| JP | 2007290395 | 11/2007 |
| JP | 2010158857 | 7/2010 |
| JP | 2013086440 | 5/2013 |
| JP | 2021519711 | 8/2021 |

* cited by examiner

PRINTING DEVICES WITH REMOVEABLE EXTRACTION RESERVOIRS

BACKGROUND

Printing devices operate to dispense a liquid onto a substrate surface. For example, a printer may operate to dispense fluid, such as ink, onto a surface, such as paper, in a predetermined pattern. In another example, an additive manufacturing liquid is dispensed as part of an additive manufacturing operation. The fluid is supplied to such printing devices from a reservoir or other supply. That is, a reservoir holds a volume of fluid that is passed to the printing device and ultimately deposited on a surface.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
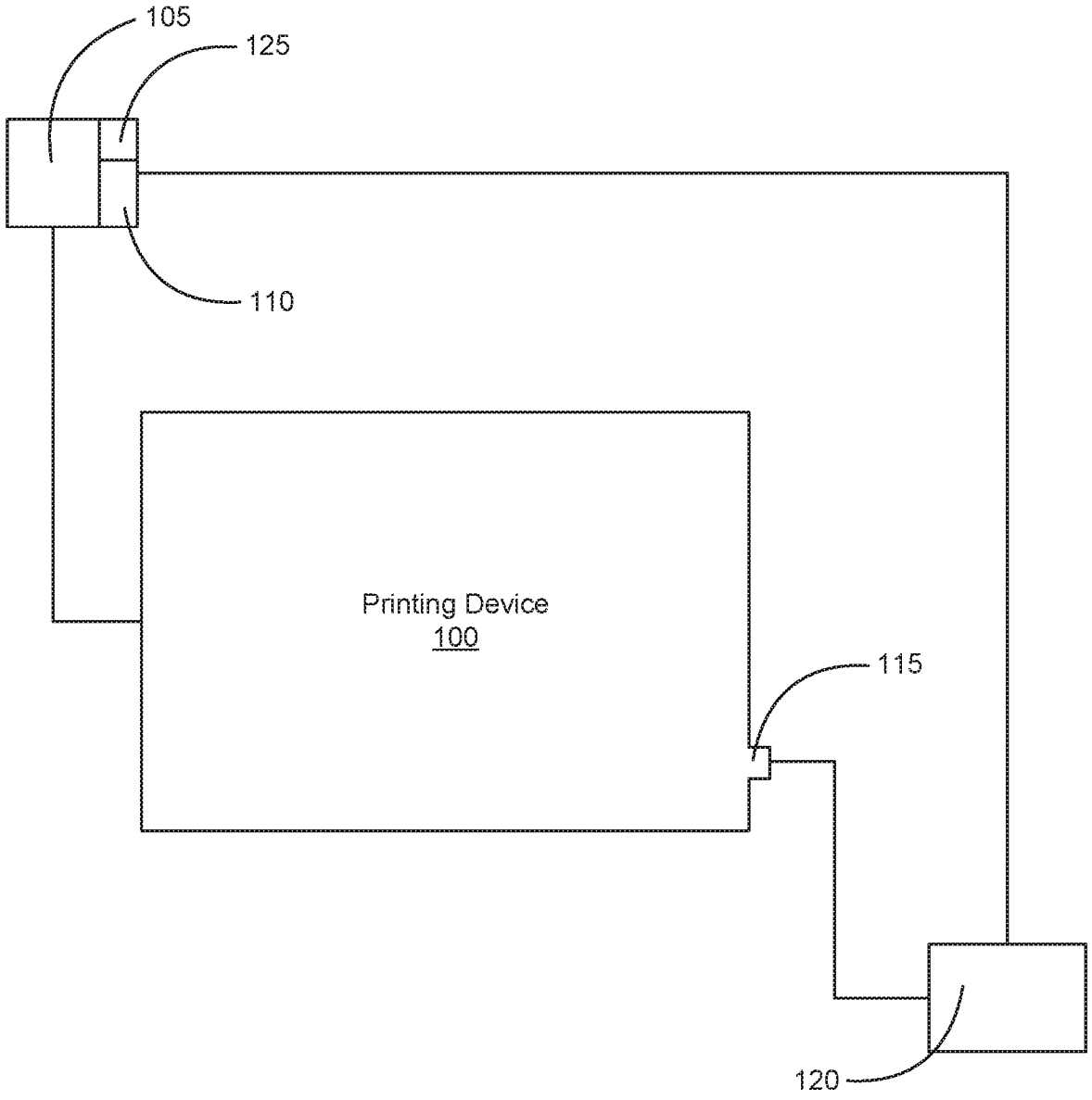
FIG. 1 is a diagrammatic view of a printing device according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluid, such as ink, in a printer and or additive manufacturing liquid in a 3D printer, is deposited on a surface from a printing device. Fluid is supplied via a reservoir that holds the fluid to be ejected. In some examples, e.g., a continuous fluid system, a reservoir is internal to the printer. Over time as the fluid is depleted from the reservoir it may be refilled or topped off from a purpose-built container.

These printing devices with continuous fluid systems may be provided as a continuous source of fluid. In some examples, a printing device may reach an end of contract date while fluid remains in a reservoir within the printing device. In this example, a fluid supplier may extract the fluid from the reservoir prior to the printing device being returned to the printing device supplier in order to prevent waste of the fluid. In an example, a decision may be made to remove a printing device, such as due to a malfunction of the printing device. In this example the fluid supplier again may extract the fluid from the reservoir prior to removal of the printing device in order to prevent waste of the fluid.

Other examples of when it may be appropriate to remove fluid such as ink from a reservoir include long term storage of the printing device and/or transportation of the printing device. In either scenario, pigments within the fluid may settle resulting in blockage in a delivery system, the fluid may dry out during long term storage, and/or the fluid may spill during the jostling that generally accompanies transportation.

As yet another example, it may be appropriate to remove fluid from a reservoir during a service, repair, and/or device replacement event (including service, repair, and/or replacement of that particular reservoir, another reservoir, or a module in which the reservoirs are disposed). Such removal may prevent the accidental spillage of the fluid during the servicing, repairing, and/or device replacement event.

In an example, the present specification describes a printing device. In any of the examples presented herein, the printing device may include an input port to interface with a supply simulator of a removable extraction reservoir. In the present specification and in the appended claims, a "supply simulator" or a "fluid supply simulator" is any device that simulates a connection with a fluid source at an input port of a printing device. Examples of "supply simulators," as described herein, may simulate a mechanical, fluidic, and/or electrical connection at the input port of the printing device with the removable extraction reservoir. In any of the examples presented herein, the printing device may include a drain fluidic interface. A drain fluidic interface may include any interface that fluidically couples an internal reservoir of a printing device to the removable extraction reservoir. The drain fluidic interface may interface with a removable extraction reservoir contemporaneously with the coupling of the supply simulator with the input port. In any of the examples presented herein, the supply simulator of the printing device may include a memory device to transfer data related to an amount of fluid transferred between the printing device and the removable extraction reservoir.

In any of the examples presented herein, the supply simulator of the removable extraction reservoir simulates, in an example, a fluidic connection between the removable extraction reservoir and the printing device. In an example, certain functions of the printing device will not be activated unless a fluid supply is coupled to the input port of the printing device. By way of example, certain pumps and valves within the printing device are prevented from functioning unless the printing device detects a fluidic, mechanical, and/or electrical connection with a fluid supply. In these examples, the supply simulator simulates the coupling of a fluid supply so that certain pumps and valves may be allowed to operate in order to, in some examples, allow the printing device to engage in a process of draining fluid from an internal reservoir of the printing device into the removable extraction reservoir.

In any of the examples presented herein, the drain fluidic interface of the printing device selectively interfaces with a needle of the removable extraction reservoir. In any of the examples presented herein, the drain fluidic interface includes a septum that prevents fluid from exiting the printing device unless the removable extraction reservoir is coupled to the drain fluidic interface.

In any of the examples presented herein, the input port of the printing device fluidically and electrically interface with the removable extraction reservoir. In any of the examples presented herein, the fluidic connection between the removable extraction reservoir and the input port is used to transfer an amount of fluid into a fluid reservoir in the printing device.

In any of the examples presented herein, the printing device may include a controller to initiate a drain/transfer process of the printing device to drain a fluid reservoir within the printing device. In any of the examples presented herein, the printing device may include a fluid level detector to detect the level of fluid within the fluid reservoir within the printing device during the drain/transfer process.

The present specification also describes a method of draining a fluid reservoir in a printing device. In any of the examples presented herein, the method may include receiving, at a processor of the printing device, an indication that a drain of the printing device is coupled to a removable extraction reservoir. In any of the examples presented herein, the method may include receiving, at the processor, an indication that an input port of the printing device is coupled to the removable extraction reservoir. In any of the examples presented herein, the method may include initiating, with the processor, a draining process to transfer an amount of fluid in a fluid reservoir of the printing device to the removable extraction reservoir. In any of the examples presented herein, the method may include monitoring and recording, with the processor, a transfer of fluid from the fluid reservoir of the printing device to the removable extraction reservoir on a memory device coupled to the removable extraction reservoir.

In any of the examples presented herein, the method may include, with the processor, determining the level of fluid within the fluid reservoir and sending a fluid level value to the memory device. In any of the examples presented herein, the method may include, with the processor, comparing the fluidic capacity of the fluid reservoir, the fluidic capacity of the removable extraction reservoir, and the amount of fluid transferred from the fluid reservoir to the removable extraction reservoir to determine a remaining fluidic capacity of the fluid reservoir and the removable extraction reservoir. In any of the examples presented herein, the method may include, with the processor: reading the memory device and determining prior use of the removeable extraction reservoir; and preventing the draining process when the memory device indicates that the removeable extraction reservoir has interfaced with a previous printing device. In an example, the memory device may indicate that the removeable extraction reservoir has no capacity remaining for storing fluid.

The present specification further describes a computer program product for controlling the draining of a fluid reservoir in a printing device. In any of the examples presented herein, the computer program product may include a computer readable storage medium including computer usable program code embodied therewith. In any of the examples presented herein, the computer usable program code of the computer readable storage medium may, when executed by a processor, receive, at a processor of the printing device, an indication that a drain of the printing device is coupled to a removable extraction reservoir. In any of the examples presented herein, the computer usable program code of the computer readable storage medium may, when executed by a processor, receive, at the processor, an indication that an input port of the printing device is coupled to the removable extraction reservoir. In any of the examples presented herein, the computer usable program code of the computer readable storage medium may, when executed by a processor, initiate, with the processor, a draining process to drain an amount of fluid in a fluid reservoir of the printing device to the removable extraction reservoir. In any of the examples presented herein, the computer usable program code of the computer readable storage medium may, when executed by a processor, record, with the processor, a transfer of fluid from the fluid reservoir of the printing device to the removable extraction reservoir on a memory device coupled to the removable extraction reservoir.

In any of the examples presented herein, the computer usable program code of the computer readable storage medium may, when executed by a processor, determine the level of fluid within the fluid reservoir and sending a fluid level value to the memory device. In any of the examples presented herein, the computer usable program code of the computer readable storage medium may, when executed by a processor, read the memory device and determining prior use of the removeable extraction reservoir and prevent the draining process when the memory device indicates that the removeable extraction reservoir includes a fluid from a fluid source different from the fluid reservoir. In an example, this computer program product and process described herein may preserve the integrity of the stored fluid.

As used in the present specification and in the appended claims, the term "fluid transportation operation" refers to an operation wherein fluid is transported through a system. Examples of fluid transportation operations include recirculation through a reservoir, recirculation through a printhead, refilling a reservoir, and extracting fluid from a reservoir.

Turning now to the figures, FIG. 1 is a diagrammatic view of a printing device (100) according to an example of the principles described herein. The printing device (100) may, in any of the examples presented herein, include an input port (105). In an example, the input port (105) may, during operation of the printing device (100), be an interface to receive a printing fluid such as ink into the printing device (100). In any of the examples presented herein, the input port (105) may interface with a supply simulator (110). As will be described herein, the supply simulator (110) may simulate a connection between a fluid source with the input port (105) of the printing device (100) although the removable extraction reservoir (120) may or may not be in the form of a fluid source acceptable by the printing device (100). In an example, the supply simulator (110) may form any of an electrical, mechanical, and/or fluidic connection with the printing device so as to simulate a fluid supply being coupled to the printing device. The supply simulator (110) may include an interface with the input port (105) that both fluidically and electrically couples the removable extraction reservoir (120) with the printing device (100).

The printing device (100), in any of the examples presented herein, may include a drain fluidic interface (115). The drain fluidic interface (115) may allow for the selective draining of a reservoir of the printing device (100). In an example, the selective draining of the reservoir of the printing device (100) may be completed upon execution of computer readable program code by a processor, controller, or other processing device associated with the printing device (100). In any of the examples presented herein, the drain fluidic interface (115) may interface with a removable extraction reservoir (120).

In any of the examples presented herein, removal or draining of a printing fluid from the reservoir of the printing device (100) may be initiated once the removable extraction reservoir (120) is fluidically coupled to the drain fluidic interface (115) and/or the supply simulator (110) is coupled to the input port (105). In any of the examples presented herein, the simultaneous coupling of the removable extraction reservoir (120) to the drain fluidic interface (115) and the supply simulator (110) to the input port (105) provides for the communication of an amount of fluid being drained from the reservoir of the printing device (100) into the removable extraction reservoir (120) to a memory device (125) associated with the removable extraction reservoir (120). The monitoring of the transfer of fluid from the reservoir of the printing device (100), through the drain fluidic interface (115), and into the removable extraction reservoir (120) may be accomplished via execution of computer readable program code by a processor associated with the printing device (100), or selectively downloaded to the printing device at the time of use.

The processor, in any of the examples presented herein, may monitor the amount of fluid transferred, the type of fluid transferred, the source of the fluid transferred before it was added to the reservoir of the printing device (100), the date of the transfer of the fluid, the duration of time the fluid had remained in the reservoir of the printing device (100) prior to draining, and the type, model number, manufacturer, and/or duration of use of the printing device (100), among other characteristics associated with the fluid and/or the printing device (100). This information may all be sent to and maintained on the memory device (125) associated with the supply simulator (110) for referencing by another or the same printing device (100) according to the examples described herein.

In any of the examples presented herein, the supply simulator (110) may simulate a fluidic connection between the removable extraction reservoir (120) and the printing device (100). In this example, simulation of the connection between the supply simulator (110) and the input port (105) of the printing device (100) may, among other things, cause the printing device (100) to receive an amount of fluid into the reservoir of the printing device (100).

In an example, the fluid in the removable extraction reservoir (120) may have been received from a printing device separate from the printing device (100) depicted in FIG. 1. In this example, the information regarding the fluid within the removable extraction reservoir (120) and the printing device that fluid was received from, is maintained on the memory device (125) of the removable extraction reservoir (120) and used by the printing device (100) to receive a transferrable amount of fluid into the reservoir of the printing device (100). In any of the examples presented herein, the information presented by the memory device (125) to the printing device (100) may determine whether the fluid within the removable extraction reservoir (120) may be added into the reservoir of the printing device (100). In an example, the fluid within the removable extraction reservoir (120) may not be compatible or, in some examples not recommended for use in the printing device (100). In this example, the processor of the printing device (100) may prevent the transfer of that fluid into the reservoir of the printing device (100) based on that information. In another example, a user interface associated with the printing device (100) may indicate to a user that the fluid in the removable extraction reservoir (120) is not compatible and/or recommended for use in the printing device (100) but still may override the prevention of fluid transfer from the removable extraction reservoir (120) to the reservoir of the printing device (100). In this example, a user may, via interfacing with the user interface, be made aware of the use of or the consequences of the use of the non-compatible and/or non-recommended fluid. The processor of the printing device (100) may also indicate the override and the use of the fluid within the removable extraction reservoir (120) by the printing device (100) for later quality assessments and/or warranty determinations. As used in the present specification and in the appended claims, the term "user" is meant to be understood as any person that may interface with the printing device (100) or its components described herein. In an example, the user may be a machine operator or a service technician. In any examples presented herein, a printing device (100) when connected to a supply simulator may electrically connect to a web service, providing information regarding a manufacture of the printing device (100), a model of the printing device, among other information describing the printing device (100), and data from the memory device on the supply simulator. In this example, the printing device (100) may request authorization sign in credentials from the operator, that when authenticated, allows the web service to return a code to the printing device (100) authorizing transfer of fluid between the printing device (100) and the supply simulator.

As described herein, the removable extraction reservoir (120) with its memory device (125) and interface to interface the drain fluidic interface (115) of a printing device (100) may be used to transfer a fluid from the reservoir of a first printing device to a second printing device. The reasons for the transfer may be based on a number of factors including, among others, the functionability of either of the printing devices, the duration of use of the fluid being transferred, and other reasons presented herein.

In any of the examples presented herein, an interface between the removable extraction reservoir (120) and the drain fluidic interface (115) may include the use of a needle by the removable extraction reservoir (120). The needle of the removable extraction reservoir (120) may interface with the drain fluidic interface (115) by insertion of the needle into, for example, a septum of the drain fluidic interface (115). The needle may therefor circumvent the blocking capabilities of the septum and allow fluid to flow from the drain fluidic interface (115) to the removable extraction reservoir (120).

The printing device (100) may further include a number of valves to selectively prevent and allow the passage of fluid into and out of the printing device (100). In an example, the printing device (100) may include a valve upstream of the drain fluidic interface (115) to selectively prevent and allow such fluid flow described herein.

In any of the examples presented herein, the printing device (100) may include any number of valves. In any of the examples presented herein, the printing device (100) may include a number of pumps to pump the fluid into and/or out of the reservoir of the printing device (100) and into or out of the removable extraction reservoir (120).

As described herein, the processor, controller, and/or other processing device (herein referred to as either a processor or a controller) may initiate a drain process within the printing device (100) in order to drain an amount of fluid from the fluid reservoir of the printing device (100). In any of the examples presented herein, any number of valves, one-way valves, and/or pumps may be used to drain the fluid from the fluid reservoir to the removable extraction reservoir (120).

In any of the examples presented herein, the printing device (100) may include a fluid level detector to detect the level of the fluid within the fluid reservoir of the printing device (100). In any of the examples presented herein, the processor may receive indications of the level of fluid within the reservoir prior to, during, and/or after the draining process described herein. This information may be received by the processor and sent to the memory device (125) associated with the supply simulator (110) to maintain a value describing the amount of fluid transferred from the fluid reservoir of the printing device (100) to the removable extraction reservoir (120). In an example, the memory device (125) may also maintain a fluidic capacity of the removable extraction reservoir (120) in order to, with the processor, determine whether the amount of fluid transferred from the reservoir of the printing device (100) exceeds the fluidic capacity of the removable extraction reservoir (120).

In any of the examples presented herein, the memory device (125) may prevent the use of the removable extraction reservoir (120) to drain fluid from a plurality of fluid reservoirs within one or a plurality of printing devices (100). As described herein, this may be done by allowing the processors of the individual printing devices (100) to read whether the removable extraction reservoir (120) has been previously used to drain another printing device. By preventing the use of the removable extraction reservoir (120) to drain fluid from a plurality of reservoirs associated with a single or plurality of printing devices (100), the printing devices (100) and/or memory device (125) may prevent the mixing of fluids within the removable extraction reservoir (120). Mixing fluids from different reservoirs together may result in a change in characteristics of the fluid within the removable extraction reservoir (120) and to be transferred to another printing device (100). If the characteristics of the fluid within the removable extraction reservoir (120) changes due to mixing different or even similar fluids therein, the reliability of the information provided to the memory device (125) qualifying that fluid as having certain characteristics may be compromised. As a result, a user may not be fully confident that the type and characteristics of the fluid transferred from a first printing device (100) to a second printing device (100) via the removable extraction reservoir (120) is acceptable to use.

Figure 2:
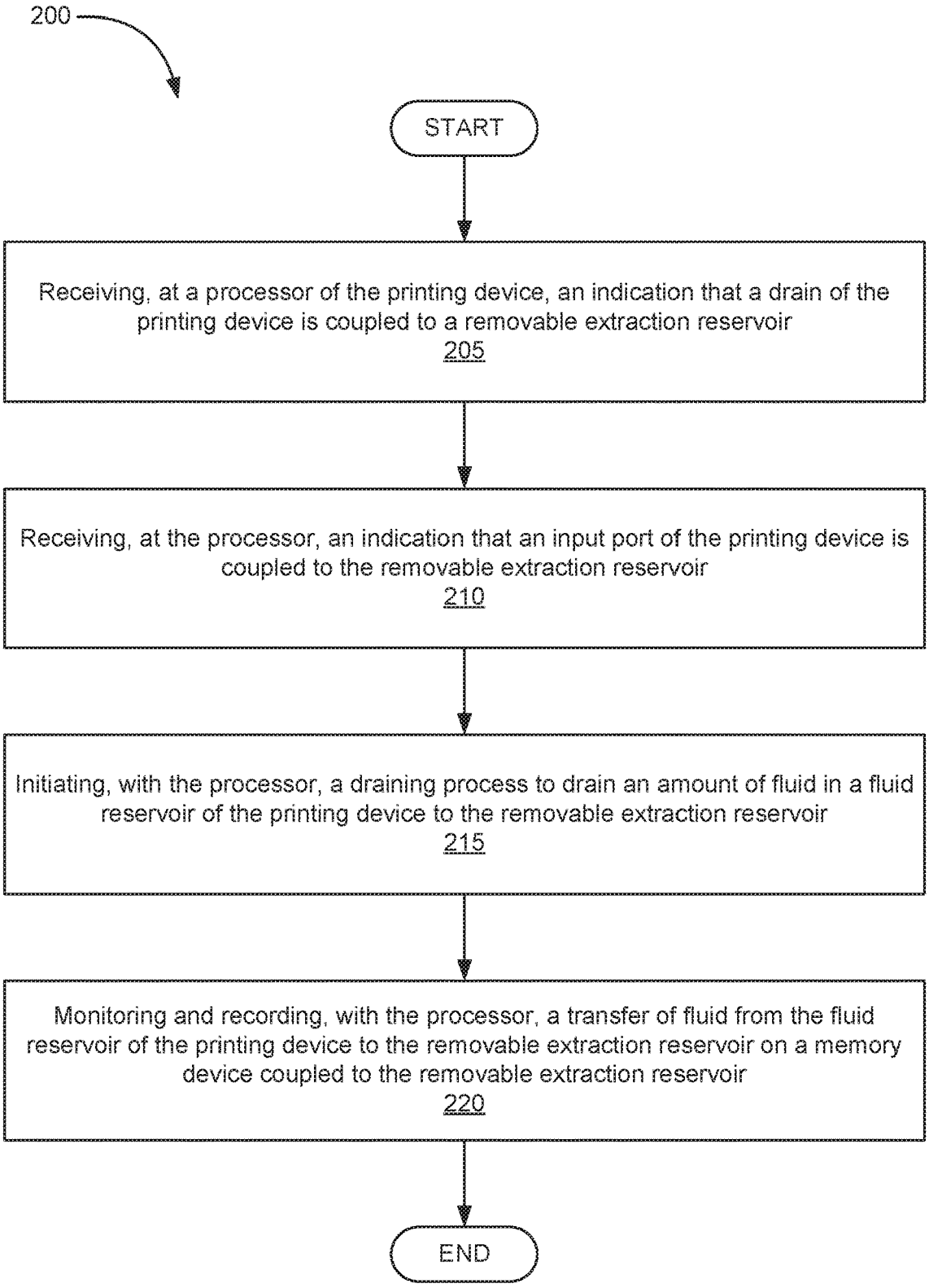
FIG. 2 is a flowchart showing a method of transferring a fluid reservoir in a printing device according to an example of the principles described herein.

FIG. 2 is a flowchart showing a method (200) of draining a fluid reservoir in a printing device (FIG. 1, 100) according to an example of the principles described herein. The method (200) may begin with receiving (205), at a processor of the printing device (FIG. 1, 100), an indication that a drain of the printing device (FIG. 1, 100) is coupled to a removable extraction reservoir (FIG. 1, 120). Such an indication may be provided to the processor using a mechanical and/or electrical signal. In an example, a detector may physically detect a fluid connection between the drain and the removable extraction reservoir (FIG. 1, 120) and, subsequently, send a signal to the processor. In an example, a user interface may be used to indicate that the user has coupled the removable extraction reservoir (FIG. 1, 120) to the drain and may include confirmation and/or instructions to the user to couple the removable extraction reservoir (FIG. 1, 120) to the drain. In any example presented herein, the printing device (FIG. 1, 100) may detect the presence of a removable extraction reservoir (FIG. 1, 120) via the presence of a supply simulator (FIG. 1, 110) and/or memory device (FIG. 1, 125). In an example a control panel and/or user may indicate that the removable extraction reservoir (FIG. 1, 120) has been coupled to the drain and may include confirmation and/or instructions to a user to couple the removable extraction reservoir (FIG. 1, 120) to the drain.

In any of the examples presented herein, the method (200) may include receiving (210), at the processor, an indication that an input port (FIG. 1, 105) of the printing device (FIG. 1, 100) is coupled to the removable extraction reservoir (FIG. 1, 120). In an example, the indication may include both an indication that the removable extraction reservoir (FIG. 1, 120) is fluidically coupled to the input port (FIG. 1, 105) and electrically coupled to the input port (FIG. 1, 105). As described herein, the removable extraction reservoir (FIG. 1, 120) may include a memory device (FIG. 1, 125). The memory device (FIG. 1, 125) may, when interfaced with the input port (FIG. 1, 105), communicate with the processor as described herein. Information provided to and from the memory device (FIG. 1, 125) may include aspects of the removable extraction reservoir (FIG. 1, 120), the printing device (FIG. 1, 100), the fluid within the removable extraction reservoir (FIG. 1, 120), and other printing devices that may have been associated with the removable extraction reservoir (FIG. 1, 120) as described herein.

In any of the examples presented herein, the method (200) may include initiating (215), with the processor, a draining process to drain an amount of fluid in a fluid reservoir of the printing device (FIG. 1, 100) to the removable extraction reservoir (FIG. 1, 120). As will be described herein, the draining process may include the activation of a number of pumps and the opening of a number of valves along a fluid path from the reservoir to the removable extraction reservoir (FIG. 1, 120). In an example, a valve may be placed upstream of the drain (e.g., the drain fluidic interface (FIG. 1, 115)) with a pump upstream of the valve. During the initiation (215) of the draining process, the pump may pump an amount of fluid towards the valve and the valve may be opened to allow the fluid to pass to the removable extraction reservoir (FIG. 1, 120).

In any of the examples presented herein, the method (200) may include monitoring and recording (220), with the processor, a transfer of fluid from the fluid reservoir of the printing device (FIG. 1, 100) to the removable extraction reservoir (FIG. 1, 120) on the memory device (FIG. 1, 125) coupled to the removable extraction reservoir (FIG. 1, 120). As described herein, monitoring (220) the amount of fluid transferred may include comparing the amount transferred from the reservoir to the removable extraction reservoir (FIG. 1, 120) and comparing that amount to a fluidic capacity of the removable extraction reservoir (FIG. 1, 120). The comparison may indicate to a processor whether and to what extent the amount of fluid being transferred is approaching a maximum fluidic capacity of the removable extraction reservoir (FIG. 1, 120). In any of the examples presented herein, the recordation of the amount of fluid transferred from the reservoir to the removable extraction reservoir (FIG. 1, 120) may be maintained on the memory device (FIG. 1, 125) for use by a processor associated with another or the same printing device (FIG. 1, 100). In this example where the fluid is to be transferred from the removable extraction reservoir (FIG. 1, 120) to the same or another printing device (FIG. 1, 100), the fluidic capacity of the reservoir of the printing device (FIG. 1, 100) the removable extraction reservoir (FIG. 1, 120) is coupled to may be compared to the recorded amount of fluid within the removable extraction reservoir (FIG. 1, 120). This comparison may be made before, during, and/or after the transfer of the fluid in the removable extraction reservoir (FIG. 1, 120), through the input port (FIG. 1, 105), and into the reservoir of the printing device (FIG. 1, 100). The comparison may be accomplished through the use of a fluid level sensor that detects the level of fluid within the fluid reservoir of the printing device (FIG. 1, 100). In order to accomplish this, the fluid level sensor may send fluid level values to the processor to make the comparisons as described here.

In any of the examples presented herein, the initiation (215), with the processor, of a draining process to drain the amount of fluid in a fluid reservoir of the printing device (FIG. 1, 100) to the removable extraction reservoir (FIG. 1, 120) may include initiating a stirring process. The stirring process may be initiated to stir any fluid within the reservoir of the printing device (FIG. 1, 100) prior to draining of the fluid from the reservoir. This may be done so as to render the fluid within the reservoir relatively more homogenous. In some instances, particles within the fluid may have settled within the reservoir of the printing device (FIG. 1, 100). By stirring the fluid within the reservoir prior to the draining process, the homogeneity of the fluid may be increased. This may be done especially in situations where a portion of the fluid within the reservoir is to be drained while a portion is to remain within the reservoir of the printing device (FIG. 1, 100).

Figure 3:
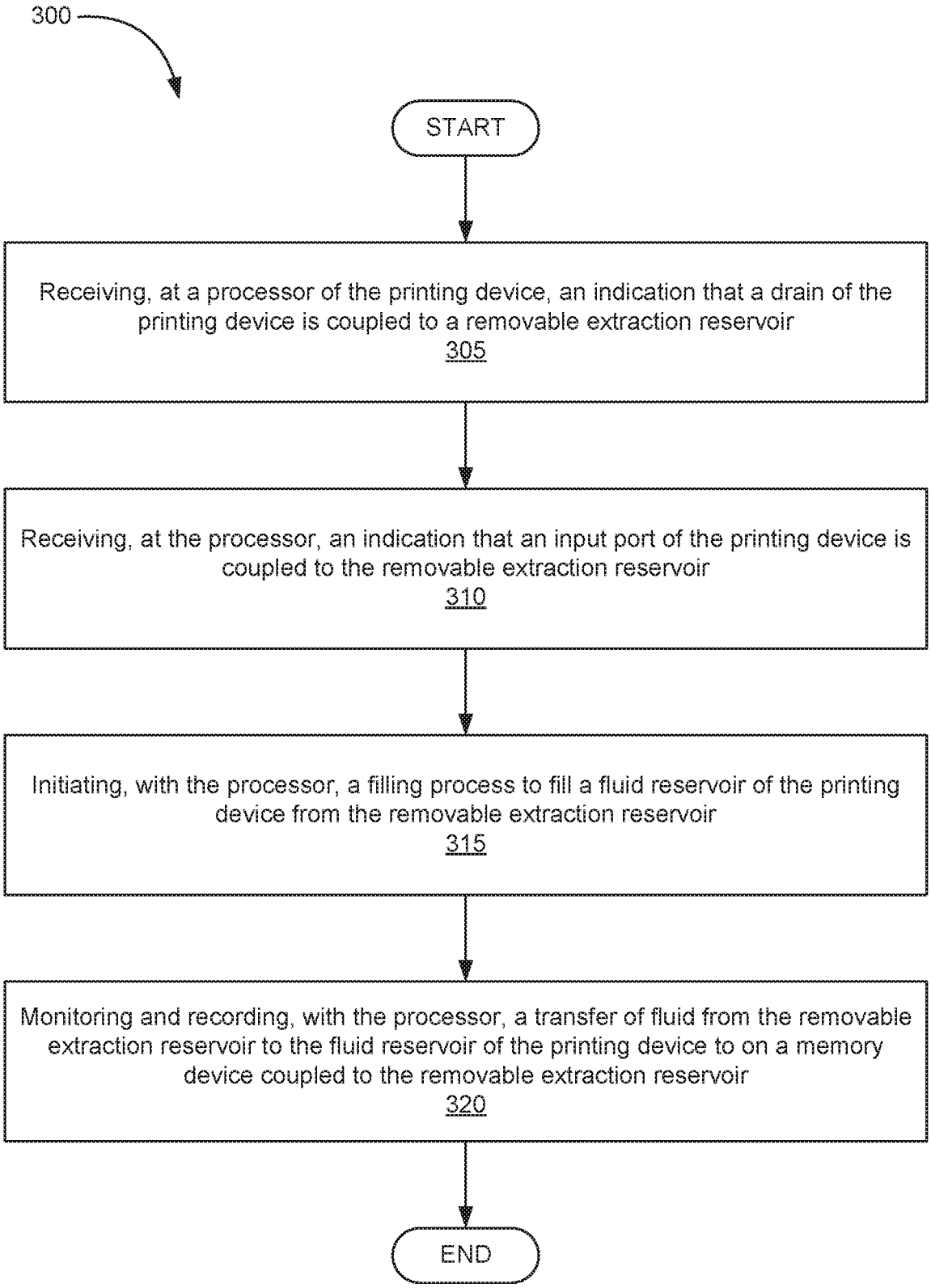
FIG. 3 is a flowchart showing a method of filling a fluid reservoir in a printing device according to an example of the principles described herein.

FIG. 3 is a flowchart showing a method (300) of filling a fluid reservoir in a printing device (FIG. 1, 100) according to an example of the principles described herein. In any of the examples presented herein, the fluid within the removable extraction reservoir (FIG. 1, 120) may have been obtained via the method (200) described in connection with FIG. 2. In any of the examples presented herein, the fluid within the removable extraction reservoir (FIG. 1, 120) may be provided to a user of the printing device (FIG. 1, 100) pre-filled with the fluid. In either case, a memory device (FIG. 1, 125) associated with and coupled to the removable extraction reservoir (FIG. 1, 120) may provide information regarding the fluid within the removable extraction reservoir (FIG. 1, 120), any prior use of the removable extraction reservoir (FIG. 1, 120), and/or the printing device (FIG. 1, 100) that previously interacted with the removable extraction reservoir (FIG. 1, 120) if applicable, among other information as described herein.

In any of the examples presented herein, the method (300) may begin with receiving (305), at a processor of the printing device (FIG. 1, 100), an indication that a drain of the printing device (FIG. 1, 100) is coupled to a removable extraction reservoir (FIG. 1, 120). In any of the examples presented herein, receiving (305) an indication that a drain of the printing device (FIG. 1, 100) is coupled to a removable extraction reservoir (FIG. 1, 120) may not be performed while filling a fluid reservoir in a printing device (FIG. 1, 100). This situation may arise when a user does not intend for or the printing device (FIG. 1, 100) is not to engage in a draining process described in connection with FIG. 2.

In any of the examples presented herein, the method (300) may include receiving (310), at the processor, an indication that an input port (FIG. 1, 105) of the printing device (FIG. 1, 100) is coupled to the removable extraction reservoir (FIG. 1, 120). In any of the examples presented herein, the coupling of the removable extraction reservoir (FIG. 1, 120) to the input port (FIG. 1, 105) may be coupled both fluidically and electrically. The removable extraction reservoir (FIG. 1, 120) is coupled to the input port (FIG. 1, 105) fluidically to allow an amount of fluid to pass from the removable extraction reservoir (FIG. 1, 120), through the input port (FIG. 1, 105), and into a reservoir within the printing device (FIG. 1, 100). The removable extraction reservoir (FIG. 1, 120) may be electrically coupled to the printing device (FIG. 1, 100) via interaction of the memory device (FIG. 1, 125) coupled to the removable extraction reservoir (FIG. 1, 120) with a processor of the printing device (FIG. 1, 100). As described herein, the memory device (FIG. 1, 125) includes information that is to be shared with the processor of the printing device (FIG. 1, 100) that may prevent or allow the fluid to be added to the reservoir of the printing device (FIG. 1, 100).

In any of the examples presented herein, the method (300) may include initiating (315), with the processor, a filling process to fill a fluid reservoir of the printing device (FIG. 1, 100) from the removable extraction reservoir (FIG. 1, 120). In an example, a user may interface with a user interface of the printing device (FIG. 1, 100) in order to initiate (315) the filling process. In any of the examples presented herein, the information provided by the memory device (FIG. 1, 125) may allow or prevent the filling of the reservoir of the printing device (FIG. 1, 100) with the fluid within the removable extraction reservoir (FIG. 1, 120). Characteristics of the fluid within the removable extraction reservoir (FIG. 1, 120) or characteristics associated with the removable extraction reservoir (FIG. 1, 120) may prevent the use of the removable extraction reservoir (FIG. 1, 120) to fill the reservoir of the printing device (FIG. 1, 100).

In any of the examples presented herein, the method (300) may include monitoring and recording (320), with the processor, a transfer of fluid from the removable extraction reservoir (FIG. 1, 120) to the fluid reservoir of the printing device (FIG. 1, 100) to on the memory device (FIG. 1, 125) coupled to the removable extraction reservoir (FIG. 1, 120). Similar to the processes described herein, the memory device (FIG. 1, 125) may also record and monitor (320) the amount of fluid transferred from the removable extraction reservoir (FIG. 1, 120) to the printing device (FIG. 1, 100). The information and/or data may include updating the amount of fluid that may remain in the removable extraction reservoir (FIG. 1, 120) as well as the amount provided to the reservoir of the printing device (FIG. 1, 100). The information may also include information regarding the characteristics of the fluid being transferred to the reservoir of the printing device (FIG. 1, 100). A processor of the printing device (FIG. 1, 100) may receive any information from the memory device (FIG. 1, 125) and store that information on a memory device, for example, associated with the printing device (FIG. 1, 100). Consequently, data associated with the transfer of a fluid from a first printing device to a second printing device may be monitored.

The memory devices associated with either the printing device (FIG. 1, 100) and/or the memory device (FIG. 1, 125) may store data such as executable program code that is executed by the processor or other processing device. The data storage device may specifically store computer code representing a number of applications that the processor executes to implement the functionality described herein.

The memory devices may include various types of memory modules, including volatile and nonvolatile memory. For example, the memory devices of the present example may include Random Access Memory (RAM), Read Only Memory (ROM), and Hard Disk Drive (HDD) memory. Many other types of memory may also be utilized, and the present specification contemplates the use of many varying type(s) of memory in the memory devices as may suit a particular application of the principles described herein. In certain examples, different types of memory in the memory devices may be used for different data storage purposes. For example, in certain examples the processor may boot from Read Only Memory (ROM), maintain nonvolatile storage in the Hard Disk Drive (HDD) memory, and execute program code stored in Random Access Memory (RAM).

Generally, the memory devices may comprise a computer readable medium, a computer readable storage medium, or a non-transitory computer readable medium, among others. For example, the memory devices may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain or store a program for use by or in connection with an instruction execution system, apparatus, or device.

Figure 4:
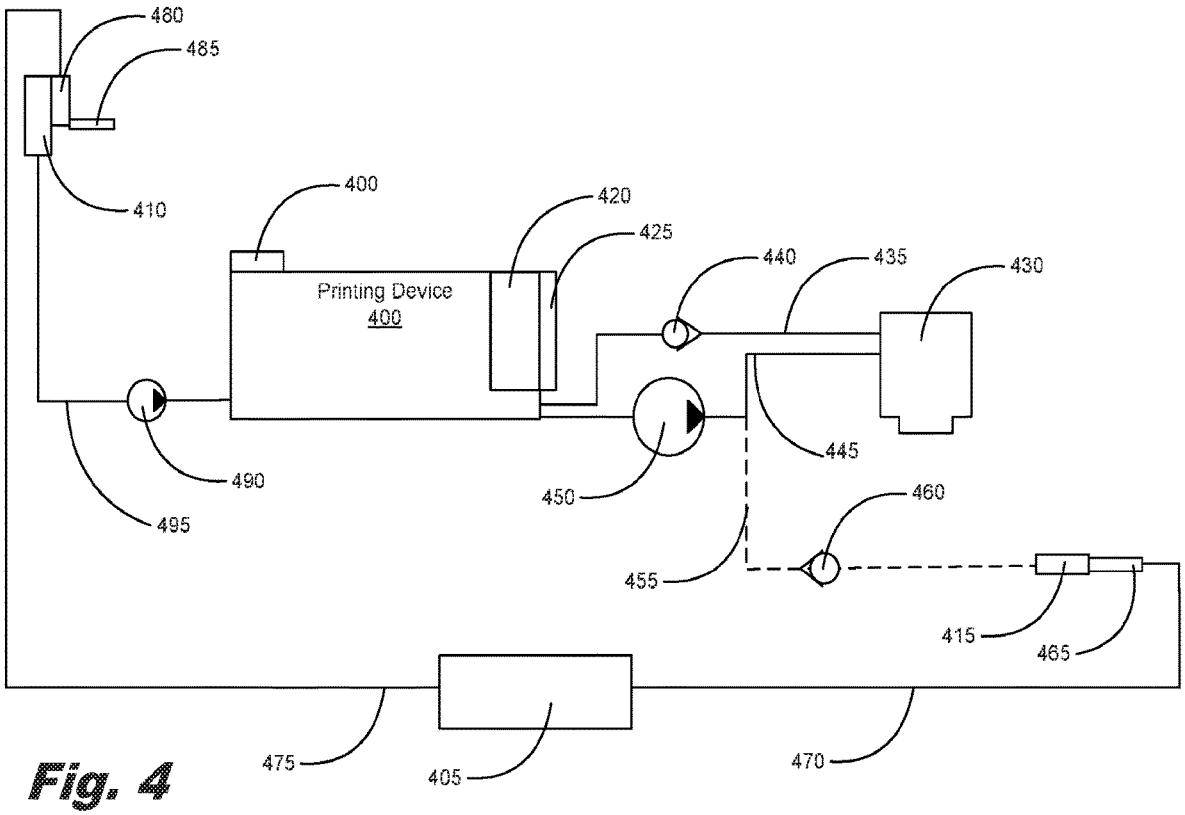
FIG. 4 is a block diagram of a printing device according to an example of the principles described herein.

FIG. 4 is a block diagram of a printing device (400) according to an example of the principles described herein. In any of the examples presented herein, the printing device (400) shown and described in FIG. 4 may include similar components as those described in connection with FIG. 1. In any of the examples presented herein, the printing device (400) may interface with a removable extraction reservoir (405) at an input port (410) and/or a drainage port (415). In any of the examples presented herein, the removable extraction reservoir (405) may be selectively coupled to either the input port (410) and/or drainage port (415) individually.

The printing device (400) may include, in any of the examples presented herein, a reservoir (420) maintained therein. The reservoir (420) may include a fluid level sensor (425) to, when executed by a processor of the printing device (400), determine at any time the level of fluid within the reservoir (420).

In any of the examples presented herein, the printing device (400) includes a printhead (430). The printhead (430) may be fluidically coupled to the reservoir (420) of the printing device (400) via a printhead fluidic channel (435). In any of the examples presented herein, the printhead fluidic channel (435) may include a printhead return check valve (440). In any of the examples presented herein, the printhead return check valve (440) may be a check valve that has a first cracking pressure in order to allow fluid passing through the printhead (430) and back into the reservoir (420) to not return back to the printhead (430). In any of the examples presented herein, the printhead return check valve (440) may increase the pressure of the fluid delivered to the printhead (430).

The printhead (430) may also be fluidically coupled to the reservoir (420) via a printhead fluid supply channel (445). The printhead fluid supply channel (445) provides fluid from the reservoir (420) of the printing device (400) to the printhead (430) so as to allow the printhead (430) to selectively deposit an amount of fluid onto a surface of a media. In any of the examples presented herein, the printhead fluid supply channel (445) may include a recirculation pump (450) to pump an amount of fluid from the reservoir (420) to the printhead (430). During a printing operation, the recirculation pump (450) may provide the fluid to the printhead (430). During a draining process of the reservoir (420) of the printing device (400) the recirculation pump (450) may pump the fluid out of the printing device (400) via a drain channel (455) and the drainage port (415).

In any of the examples presented herein, the drain channel (455) may include a drain channel check valve (460). The drain channel check valve (460) may be a one-way valve to prevent backflow of fluid into the reservoir (420). Additionally, the drain channel check valve (460) may be a one-way valve that prevents injection of an unknown fluid into the reservoir (420) via the drain channel check valve (460) and drain channel (455). This prevents the introduction of a fluid into the reservoir (420) without the printing device (400) determining that the fluid has been introduced or what kind or type of fluid is being introduced into the reservoir (420). Consequently, this prevents the introduction of fluid into the reservoir (420) that may damage the printing device (400) or fluid that may produce an inferior printed product.

In any of the examples presented herein, the drain channel check valve (460) may have a cracking pressure that is relatively lower than the cracking pressure of the printhead return check valve (440). This is done so as to assure that when the recirculation pump (450) begins to pump fluid through the drain channel (455) during a draining process that the fluid flows into the drain channel (455) rather than continuing to pump fluid through the printhead (430) and back into the reservoir via the printhead return check valve (440).

In any of the examples presented herein, the drainage port (415) may interface with a drain interface (465) of the removable extraction reservoir (405). In any of the examples presented herein, the drain interface (465) may include a needle that may interface with a septum of the drainage port (415). The needle may allow for the fluid to flow from the drain channel (455) to the removable extraction reservoir (405) via a removable drain channel (470).

In any of the examples presented herein, the removable extraction reservoir (405) may include a removable supply channel (475). The removable supply channel (475) may be coupled to the input port (410) of the printing device (400) in order to allow fluid within the removable extraction reservoir (405) to be pulled into the reservoir (420) of the printing device (400) during a filling process described herein.

At a distal end of the removable supply channel (475), the removable extraction reservoir (405) may include a supply simulator (480) and a memory device (485). As described herein, the supply simulator (480) with the memory device (485) may electrically and fluidically couple the removable extraction reservoir (405) to the printing device (400). In any of the examples presented herein, the coupling of the supply simulator (480) and its memory device (485) to the printing device (400) allows for fluid to be transferred from the removable extraction reservoir (405) to the reservoir (420) of the printing device (400). In an example, the supply simulator (480) may simulate the presence of a fluid supply being coupled to the input port (410) of the printing device (400) such that a processor of the printing device (400) may allow the fluid to be transferred into the reservoir (420).

In any of the examples presented herein, the memory device (485) may be used to communicate with a processor of the printing device (400). As described herein, the communication may include the transfer of data to and from the memory device (485) and the processor of the printing device (400). Examples of data received from the memory device (485) to the processor of the printing device (400) may include data describing the fluid within the removable extraction reservoir (405) including chemical compositions, age of the fluid, and date the fluid was placed in the removable extraction reservoir (405); data describing where the removable extraction reservoir (405) received the fluid therein; and data describing any prior use of the removable extraction reservoir (405) such as fluidic connections with other printing devices (400), among other types of information and data. Data provided to the memory device (485) and to be stored on the memory device (485) may include data describing the fluid within the reservoir (420) and/or transferred to the removable extraction reservoir (405) such as the chemical compositions of the fluid, age of the fluid, and date the fluid was placed in the reservoir (420) and transferred to the removable extraction reservoir (405).

Once coupled, the removable extraction reservoir (405) may have fluid removed therefrom using an input pump (490) via an input channel (495). The input pump (490) may be selectively activated by the processor of the printing device (400). In some instances, the fluid maintained within the removable extraction reservoir (405) may be unsuitable for use in the printing device (400). The processor of the printing device (400) may determine the suitability of the fluid for the printing device (400) by accessing the data saved on the memory device (485) and associated with the fluid within the removable extraction reservoir (405) and the removable extraction reservoir (405) itself. The printing device (400) may further include, in any example presented herein, a vent (496) to allow the internal reservoir (420) to vent to atmosphere.

Consequently, the removable extraction reservoir (405) may be used in connection with the printing device (400) to both drain fluid from the reservoir (420) as well as provide fluid to the reservoir (420) of the printing device (400) or any other printing device. The transfer of a printing fluid from one printing device (400) to a different printing device (400) may be controlled via the information maintained on the memory device (485) as read by the processor. This prevents the use of a fluid in any printing device (400) where such use is unacceptable or may damage the printing device (400). This may also prevent the use of a fluid that could be used within the printing device (400) but may void any warranties associated with the printing device (400) or may produce inferior printed output printed by the printing device (400). In this example, a user may override the prevention of the use of the fluid within the removable extraction reservoir (405) via a user interface of the printing device (400) acknowledging the recommendation to not use the fluid. In any examples presented herein, the printing device (400) when connected to a supply simulator may electrically connect to a web service, providing information regarding a manufacture of the printing device (400), a model of the printing device (400), among other information describing the printing device (400), and data from the memory device on the supply simulator. In this example, the printing device (400) may request authorization sign in credentials from the operator, that when authenticated, allows the web service to return a code to the printing device (400) authorizing transfer of fluid between the printing device (400) and the supply simulator.

Figure 5:
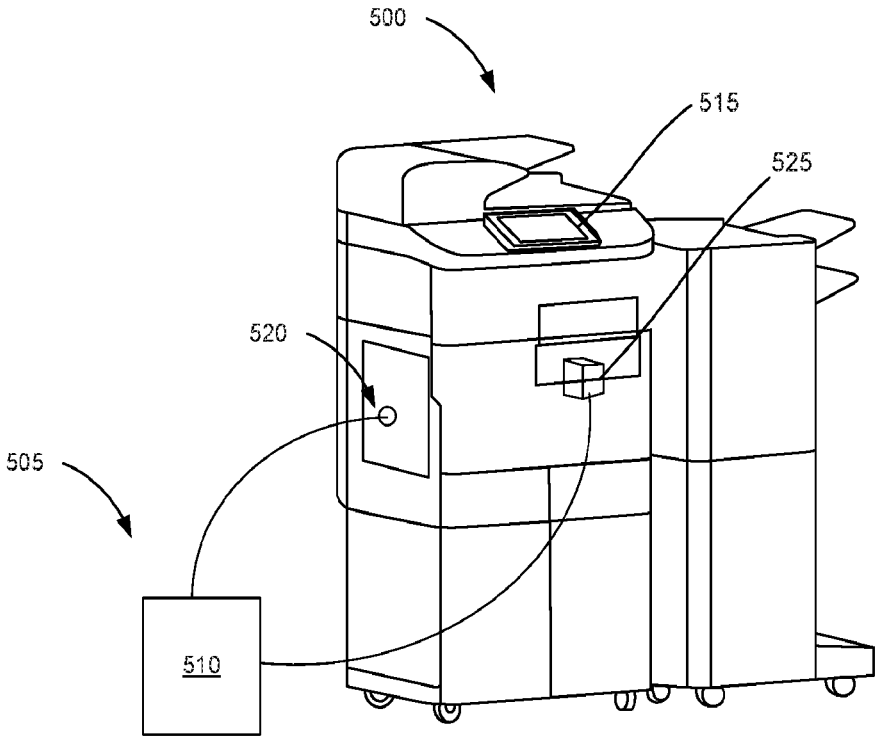
FIG. 5 is an isometric view of a printing device with a fluid extraction system for extracting fluid to a removable extraction reservoir according to an example of the principles described herein.

FIG. 5 is an isometric view of a printing device (500) with a fluid extraction system (505) for extracting fluid to a removable extraction reservoir (510) according to an example of the principles described herein. In this example, the fluid extraction system (505) includes the removable extraction reservoir (510) to which the fluid is extracted. As described above, the removable extraction reservoir (510) has a corresponding interface that mates with an interface (520) of the printing device (500) such that fluid can be transferred between the printing device (500) and the removable extraction reservoir (510).

The removable extraction reservoir (510) refers to a device that holds fluid. The fluid may be any type including ink for 2D printing and/or an additive manufacturing fabrication agent. The removable extraction reservoir (510) may take many forms. For example, the removable extraction reservoir (510) may include a pliable reservoir that conforms to the contents disposed therein. Because a pliable reservoir is difficult to handle and manipulate, it may be disposed in a rigid container, for example a corrugated fiberboard carton.

The removable extraction reservoir (510) may include channels and openings to facilitate the extraction of the fluid and in some examples delivery of fluid to the printing device (500). In some examples, the opening to the removable extraction reservoir (510) may have a port or closing such that when the removable extraction reservoir (510) is not disposed in a printing device (500), the fluid therein does not leak out.

The removable extraction reservoir (510) also includes an electrical connection (525) to establish a data transmission path between the removable extraction reservoir (510) and the printing device (500), specifically the processor of the printing device (500). Many different types of data may be transmitted via this connection as described above. For example, information regarding a formulation of the ink, a capacity of the removable extraction reservoir (510), etc., may be included on a memory device of the removable extraction reservoir (510). This information may be passed to the printing device (500) to verify the removable extraction reservoir (510), authenticate the removable extraction reservoir (510), or to adjust the operation of fluidic extraction in order to optimize performance. While specific reference is made to particular pieces of information, additional pieces of data can also be transferred via the electrical interface.

As described above, the interface (520) of the printing device (500) mates with an interface on the removable extraction reservoir (510). For example, the interface of the printing device (500) may include a needle to be inserted into a removable extraction reservoir (510). The needle may be hollow and allow fluid to pass there through. The needle may pierce a septum on the removable extraction reservoir (510) and be put in fluidic communication with contents of the removable extraction reservoir (510). In another example, a valve or gasket may be present on the removable extraction reservoir (510) and the needle may pass through the valve or gasket.

In some examples, the interface (520) of the printing device (500) includes a retractable plate. The retractable plate has two positions, a retracted position and an extended position. The retractable plate may be in the extended position when the port is empty, that is when a removable extraction reservoir (510) is not attached. In the extended position, the retractable plate extends past the interface of the printing device (500) to protect various components. That is, the needle may be a fragile component as may the circuitry that makes up the electrical connection. Accordingly, the retractable plate may extend past these components to prevent any mechanical force from damaging these components.

In a retracted position, that is when a removable extraction reservoir (510) is inserted, the retractable plate retracts to 1) expose the needle to the removable extraction reservoir (510) and 2) expose the electrical contacts to corresponding contacts on the removable extraction reservoir (510). A latch assembly of the interface of the printing device (500) controls the movement of the retractable plate and is activated by keying features. For example, the keying features may be keyed slots that gate insertion to just those removable extraction reservoir (510) with matching keying features. As a specific example, keyed slots 1) allow matching protrusions to act upon rods to actuate the retractable plate and 2) prevent non-matching protrusions from acting upon the rods.

Upon insertion, protrusions on the removable extraction reservoir (510), if they match the keyed slots, press against the retractable plate to expose the components of the interface of the printing device (500) to facilitate fluid transportation.

In some examples, the protrusions on a removable extraction reservoir (510) have a size and shape that are unique to particular keyed slots of the interface of the printing device (500). If the protrusions match a size and shape of associated keyed slots, the protrusions may pass through and interface with the retractable plate. The particular shape and size of the slots and protrusions may be unique to a particular type of fluid. For example, the shape and size may relate to a particular color of ink that is intended to be inserted into that particular port. Accordingly, interfaces on removable extraction reservoir (510) to be used with particular colors would have different shaped and sized protrusions and therefore would not be able to be inserted into the port on account of not matching up with the associated keyed slots. Put another way, the keyed slots gate insertion of removable extraction reservoir (510). That is, a printing device (500) may have ports into which removable extraction reservoirs (510) are disposed. In this example, certain types of liquid be inserted into particular ports.

As a specific example, where the fluid is ink, certain colors of ink are disposed in certain ports. Accordingly, via the keyed slots it may be ensured that just a desired removable extraction reservoir (510) is inserted into a particular port. A removable extraction reservoir (510) of that fluid type or color of ink may have protrusions that match the shape of the keyed slots. In this example, those similarly-shaped protrusions fit into the keyed slots and can therefore mate with the interface of the printing device (500). By comparison, if a user tries to insert a removable extraction reservoir (510) for a different type or a different color ink into that port, the protrusions would not match the keyed slots and that different removable extraction reservoir (510) would not be insertable into that particular port.

In some examples, the printing device (500) may include multiple interfaces with each interface being uniquely keyed to a removable extraction reservoir (510) with different characteristics as described above. For simplicity of illustration, a single removable extraction reservoir (510) is depicted as being coupled to the printing device (500). However, the fluidic extraction system (505) may be able to extract fluid from multiple internal reservoirs to multiple removable extraction reservoirs (510).

In some examples, internal reservoirs corresponding to empty interfaces of the printing device (500) may circulate fluid through a fluid transport system while a reservoir corresponding to a populated interface is depleted. In this example, each internal reservoir may be driven by a single pump. In other examples where each internal reservoir is driven by a unique pump, pumps corresponding unpopulated interfaces may be deactivated.

In some examples, the printing device (500) includes a display (515). In addition to other operations, the display (515) may indicate a status of the fluid extraction operation. That is, the display (515) may include a real-time indication of fluid level in an internal reservoir and/or an estimate of the time remaining until full fluidic extraction. In any of the examples presented herein, the display (515) may also serve as an interface to communicate to a user the type of fluid being transferred into or out of the printing device (500). In this example, the user may be notified about certain types of fluid being introduced into the printing device (500) and allow the user to prevent or allow the transfer despite a warning that such a transfer may reduce the quality of printed products of the printing device (500) or may void a warranty associated with the printing device (500). In an example, the display may be used to authenticate the user requesting the transfer of fluid between the printer and supply simulator.

FIGS. 6A-6E are diagrams of various fluid transport operations, according to an example of the principles described herein. In FIGS. 6A-6E the symbol "→" in a pump (614, 616) indicates the pump (614, 616) is actively moving fluid whereas the symbol "X" for a pump (614, 616) indicates the pump (614, 616) is idle and not moving fluid. In FIGS. 6A-6E the symbol "→" in the valve (618) indicates the valve (618) is open such that fluid may pass whereas the symbol "X" for a valve (618) indicates the valve (618) is inactive and fluid may not pass. FIGS. 6A-6E also depict a fluid level sensor (620). The fluid level sensor (620) is disposed on, or in, the reservoir (612) and defines when to terminate a fluid delivery operation. That is, the fluid level sensor (620) may indicate when the reservoir (612) is full such that a reservoir (612) fill operation may be terminated. In another example, the fluid level sensor (620) may indicate when the reservoir (612) is empty such that a fluid extraction operation may be terminated.

FIGS. 6A-6E also depict the printhead (622) from which fluid is ejected. That is the printhead (622) may include various ejecting components that include chambers where a small amount of fluid is held. The controller (604) or another controller then activates at particular times to eject fluid from the chambers through an opening in a desired pattern. In this fashion, fluid is deposited on a substrate in a desired pattern in 2D printing, 3D printing, or another ejection operation.

Figure 6A:
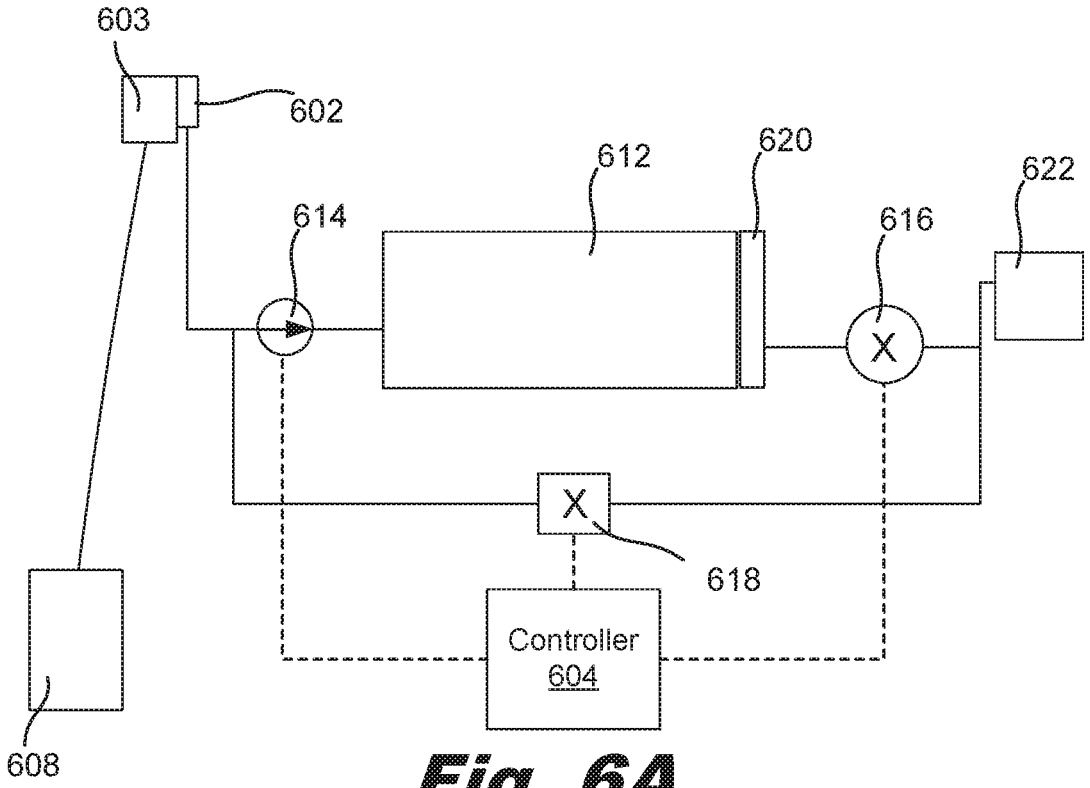
FIGS. 6A-6E are diagrams of various fluid transport operations according to an example of the principles described herein.

FIG. 6A depicts a reservoir (612) fill operation wherein fluid is passed from the removable extraction reservoir (608) to the internal reservoir (612) via the input port (602) using a supply simulator (603) as described herein. To effectuate a fluid refill operation, the controller (604) deactivates a pump (616) downstream of the reservoir (612) such that fluid does not flow out of the reservoir (612). The controller (604) also closes the valve (618) and activates a pump (614) between the removable extraction reservoir (608) and the internal reservoir (612) such that fluid is drawn from the removable extraction reservoir (608) to the internal reservoir (612). Such an operation may be controlled, in part, via data extracted from the removable extraction reservoir (608).

Figure 6B:
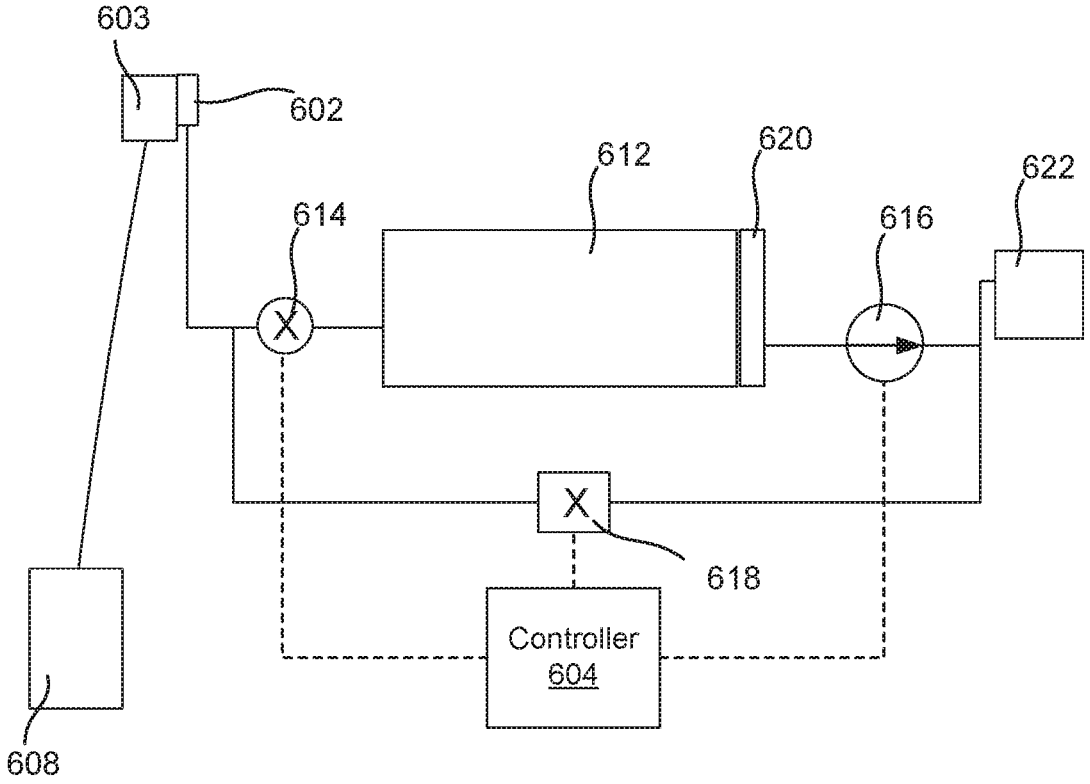

FIG. 6B depicts a printhead (622) fluid recirculation operation wherein fluid is passed from the reservoir (612) in the printing device to the printhead (622). That is, in some examples it may be desirable to circulate fluid between the printhead (622) and the reservoir (612). Doing so ensures that fresh fluid is available to the printhead (622). The use of fresh fluid in the printhead (622) may enhance quality as fresh fluid, such as ink, has characteristics that lead to enhanced printing. To effectuate a printhead (622) fluid recirculation operation, the controller (604) activates a pump (616) downstream of the reservoir (612) such that fluid may pass. The controller (604) also closes the valve (618) so as to not draw fluid away from the printhead (622). The controller (604) also deactivates the pump (614) between the removable extraction reservoir (608) and the internal reservoir (612). Such an operation may be controlled, in part, via data extracted from the removable extraction reservoir (608).

Figure 6C:
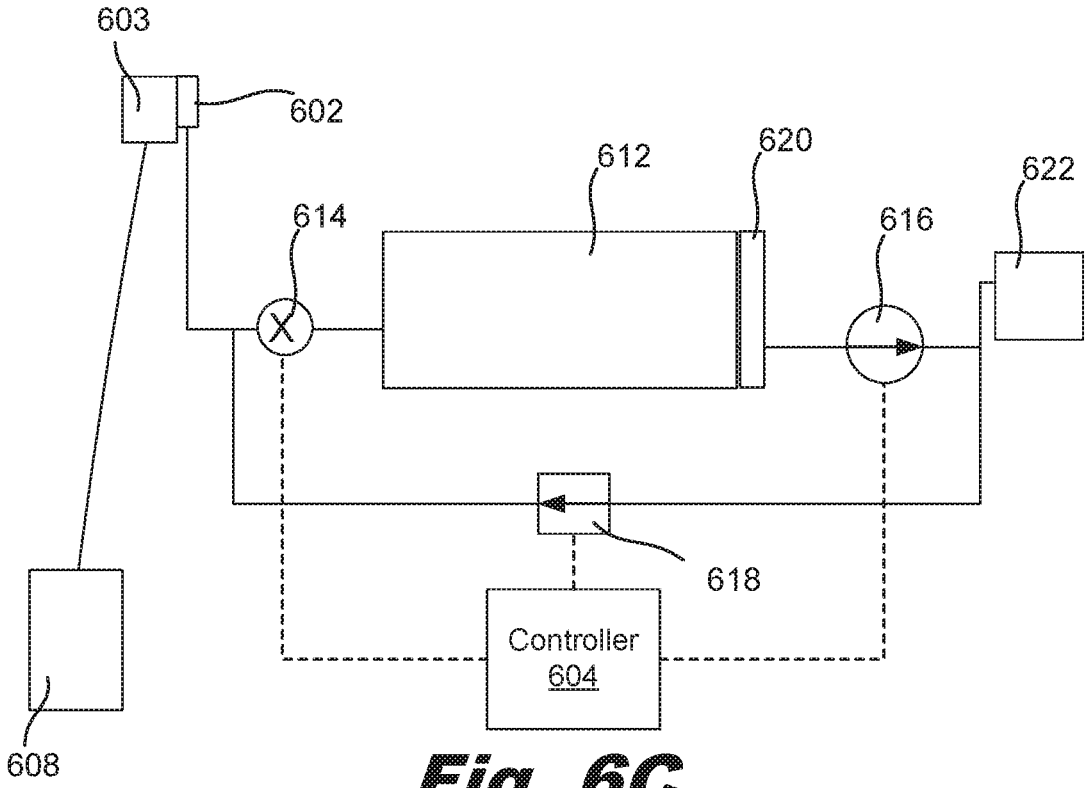

FIG. 6C depicts a fluid extraction operation wherein fluid is passed from the reservoir (612) in the printing device to the removable extraction reservoir (608). As described above, there are a number of reasons why it would be desirable to extract fluid from a reservoir (612). To effectuate a fluid extraction operation, the controller (604) activates a pump (616) downstream of the reservoir (612) such that fluid may pass. The controller (604) also opens the valve (618) so as allow fluid to pass towards the removable extraction reservoir (608). The controller (604) also deactivates the pump (614) between the removable extraction reservoir (608) and the internal reservoir (612) so as to not draw the fluid back to the reservoir (612). Such an operation may be controlled, in part, via data extracted from the removable extraction reservoir (608).

Figure 6D:
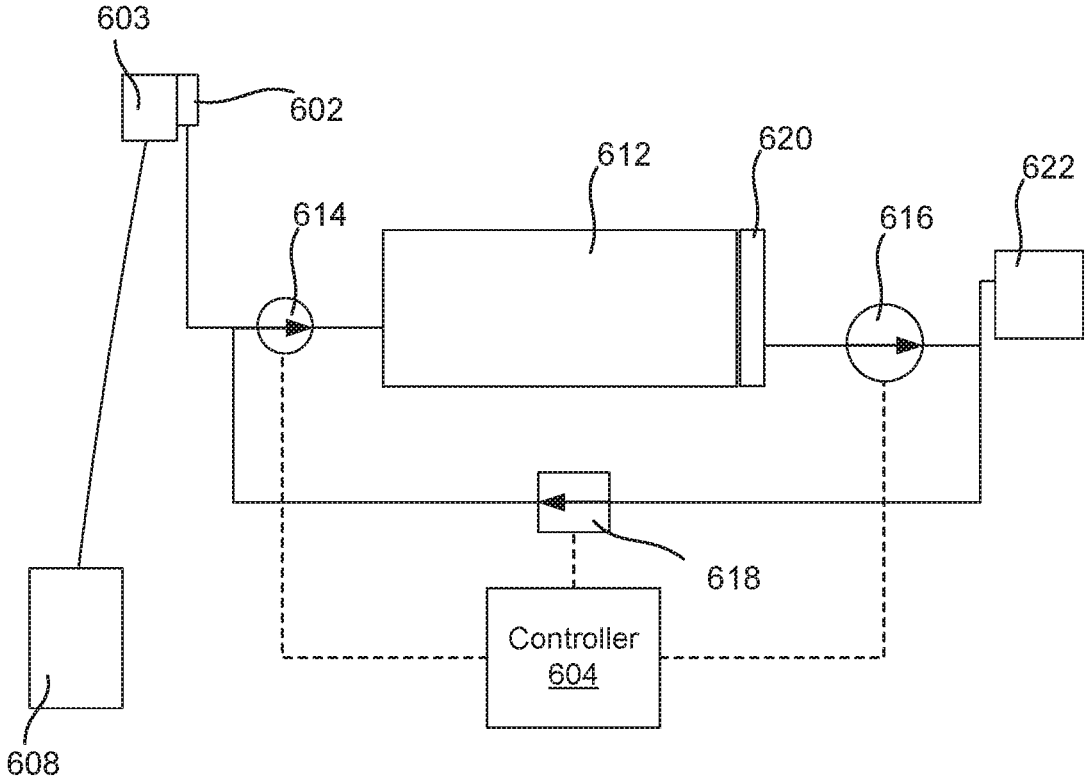

FIG. 6D depicts a reservoir (612) fluid recirculation operation wherein fluid is recirculated through the reservoir (612). That is, in some examples it may be desirable to circulate fluid through the reservoir (612), for example to prevent pigment settling at the bottom of the reservoir (612), which settling can lead to print defects and blockage. To effectuate a reservoir (612) fluid recirculation operation, the controller (604) activates a pump (616) downstream of the reservoir (612) such that fluid may pass. The controller (604) also opens the valve (618) to let fluid pass. The controller (604) also activates the pump (614) between the removable extraction reservoir (608) and the internal reservoir (612). Such an operation may be controlled, in part, via data extracted from the removable extraction reservoir (608).

Figure 6E:
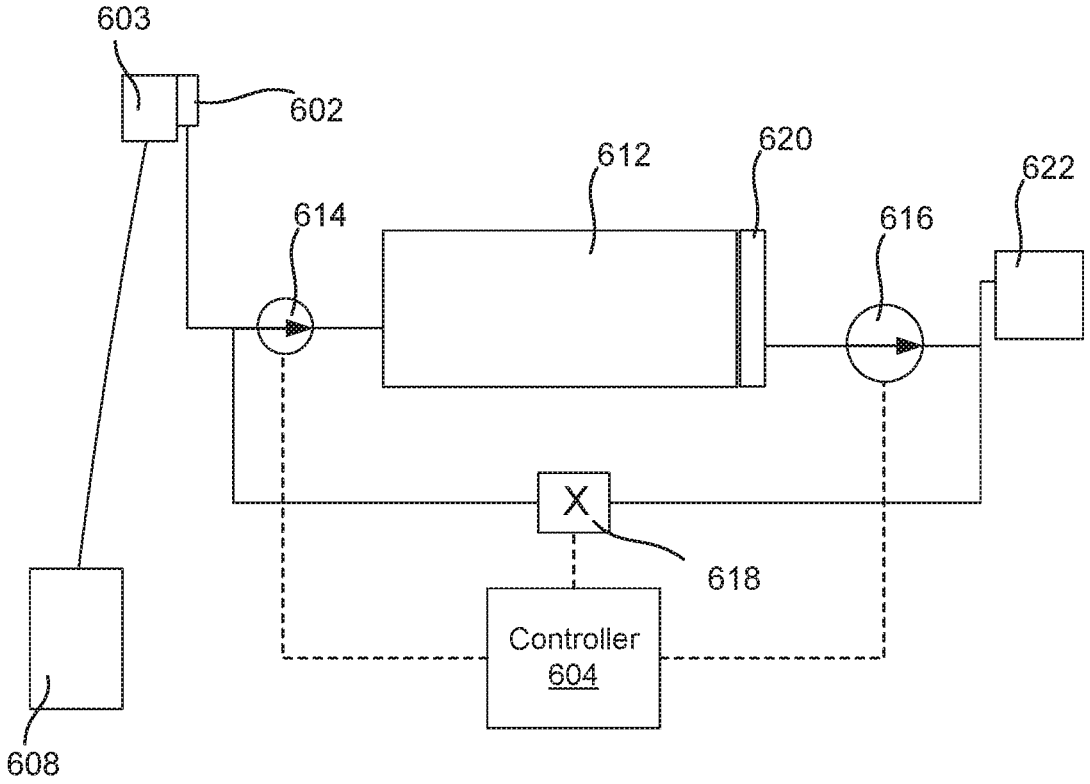

FIG. 6E depicts an operation wherein fluid is refilled from the removable extraction reservoir (608) to the reservoir (612) while the fluid is passed from the reservoir (612) to the printhead (622). That is, refilling from the removable extraction reservoir (608) may occur during printing. Such a refilling without printing interruption enhances performance as a user does not interrupt a printing operation to refill the fluid. To effectuate a reservoir (612) refill operation during printing, the controller (604) activates a pump (616) downstream of the reservoir (612) such that fluid may pass. The controller (604) also closes the valve (618) so as to not draw fluid towards the removable extraction reservoir (608). The controller (604) also activates the pump (614) between the removable extraction reservoir (608) and the internal reservoir (612) so as to draw the fluid from the removable extraction reservoir (608) to the reservoir (612). Such an operation may be controlled, in part, via data extracted from the removable extraction reservoir (608). In any of the example presented herein, any executable program code or data from the printing device may be maintained on a USB drive communicatively coupled to the printing device by the user, in the supply simulator memory device, resident in printer non-volatile memory, or downloaded from the web (with or without authentication of the user and simulator) at time of use.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, the processor of the printing device or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a printing device that interfaces with a removeable extraction reservoir. The interfacing of the printing device with the removeable extraction reservoir allows for the removal or addition of fluid into a fluid reservoir of a printing device. Such a system 1) prevents disposal of otherwise usable fluid disposed within an out-of-contract/non-functioning printing device; 2) reduces financial exposure for fluid suppliers as they can reclaim fluid dispensed in an out-of-contract/non-functioning printing device; 2) prevents printing device failure due to ink drying out during long term storage; 3) reduces service cost and complexity; 4) prevents re-fill with unauthorized fluid; 5) allows printing device recyclability without fluid in reservoir; 6) enables extraction from a single reservoir; and 7) enables secure reclamation and refilling of ink.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing device, comprising:

an input port to interface with a supply simulator; and a drain fluidic interface to interface with a removable extraction reservoir simultaneously with the coupling of the supply simulator with the input port;

the supply simulator comprising a memory device to transfer data related to an amount of fluid transferred between the printing device and the removable extraction reservoir.

2. The printing device of claim 1, wherein the supply simulator forms a fluidic connection between the removable extraction reservoir and the printing device.

3. The printing device of claim 2, wherein the supply simulator forms an electrical connection to the printer to simulate a fluid supply coupled to the printing device.

4. The printing device of claim 1, wherein the drain fluidic interface selectively interfaces with a needle of the removable extraction reservoir.

5. The printing device of claim 4, wherein drain fluidic interface comprises a septum that prevents fluid from exiting the printing device unless the removable extraction reservoir is coupled to the drain fluidic interface.

6. The printing device of claim 1, comprising a printhead check valve downstream of a pump and printhead wherein the printhead check valve increases a pressure of the fluid delivered to the printhead.

7. The printing device of claim 6, comprising a drain channel check valve upstream of the drain fluidic interface wherein a cracking pressure of the drain channel check valve is lower than a cracking pressure of the printhead check valve.

8. The printing device of claim 1, the printing device comprising a controller to initiate a drain process in the printing device to drain a fluid reservoir within the printing device.

9. The printing device of claim 8, comprising a fluid level detector to detect the level of fluid within the fluid reservoir within the printing device during the drain process.

10. A method of draining a fluid reservoir in a printing device, comprising:

receiving, at a processor of the printing device, an indication that a drain of the printing device is coupled to a removable extraction reservoir;

receiving, at the processor, an indication that an input port of the printing device is coupled to the removable extraction reservoir;

initiating, with the processor, a draining process to transfer an amount of fluid in a fluid reservoir of the printing device to the removable extraction reservoir; and monitoring and recording, with the processor, a transfer of fluid from the fluid reservoir of the printing device to the removable extraction reservoir on a memory device coupled to the removable extraction reservoir.

11. The method of claim 10, comprising, with the processor, determining the level of fluid within the fluid reservoir and sending a fluid level value to the memory device.

12. The method of claim 10, comprising, with the processor, comparing the fluidic capacity of the fluid reservoir, the fluidic capacity of the removable extraction reservoir, and the amount of fluid transferred from the fluid reservoir to the removable extraction reservoir to determine a remaining fluidic capacity of the fluid reservoir and the removable extraction reservoir.

13. The method of claim 10, comprising, with the processor:

reading the memory device and determining prior use of the removeable extraction reservoir; and preventing the draining process when the memory device indicates that the removeable extraction reservoir has interfaced with a previous printing device.

14. A computer program product for controlling the draining of a fluid reservoir in a printing device, the computer program product comprising:

a computer readable storage medium comprising computer usable program code embodied therewith, the computer usable program code to, when executed by a processor:

receive, at a processor of the printing device, an indication that a drain of the printing device is coupled to a removable extraction reservoir;

receive, at the processor, an indication that an input port of the printing device is coupled to the removable extraction reservoir;

initiate, with the processor, a draining process to drain an amount of fluid in a fluid reservoir of the printing device to the removable extraction reservoir; and record, with the processor, a transfer of fluid from the fluid reservoir of the printing device to the removable extraction reservoir on a memory device coupled to the removable extraction reservoir.

15. The computer program product of claim 14, comprising computer usable program code to, when executed by a processor, determine the level of fluid within the fluid reservoir and sending a fluid level value to the memory device.

16. The computer program product of claim 14, comprising computer usable program code to, when executed by a processor:

read the memory device and determining prior use of the removeable extraction reservoir; and prevent the draining process when the memory device indicates that the removeable extraction reservoir includes a fluid from a fluid source different from the fluid reservoir.

* * * * *